US008701681B2

(12) United States Patent
Rasouli et al.

(10) Patent No.: US 8,701,681 B2
(45) Date of Patent: Apr. 22, 2014

(54) USE OF OXYHYDROXIDE COMPOUNDS IN CIGARETTE PAPER FOR REDUCING CARBON MONOXIDE IN THE MAINSTREAM SMOKE OF A CIGARETTE

(75) Inventors: Firooz Rasouli, Midlothian, VA (US); Ping Li, Richmond, VA (US); Wei-Jun Zhang, Richmond, VA (US); Shalva Gedevanishvili, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 1667 days.

(21) Appl. No.: 10/972,207

(22) Filed: Oct. 25, 2004

(65) Prior Publication Data

US 2005/0155616 A1 Jul. 21, 2005

Related U.S. Application Data

(60) Provisional application No. 60/514,529, filed on Oct. 27, 2003.

(51) Int. Cl.

| | |
|---|---|
| ***A24D 1/02*** | (2006.01) |
| ***D21H 11/00*** | (2006.01) |
| ***D21H 13/00*** | (2006.01) |
| ***D21H 15/00*** | (2006.01) |
| ***D21H 17/00*** | (2006.01) |
| ***D21H 19/00*** | (2006.01) |
| ***D21H 21/00*** | (2006.01) |
| ***D21H 23/00*** | (2006.01) |
| ***D21H 25/00*** | (2006.01) |
| ***D21H 27/00*** | (2006.01) |

(52) U.S. Cl.
USPC ..... 131/365; 131/364; 131/375; 131/359

(58) Field of Classification Search
None
See application file for complete search history.

(56) References Cited

U.S. PATENT DOCUMENTS

| | | | | |
|---|---|---|---|---|
| 3,127,901 | A | | 4/1964 | Whitefield et al. |
| 3,545,448 | A | | 12/1970 | Troon et al. |
| 3,638,660 | A | | 2/1972 | Davis |
| 3,720,214 | A | | 3/1973 | Norman et al. |
| 3,807,416 | A | | 4/1974 | Hedge et al. |
| 3,874,390 | A | | 4/1975 | Eicher et al. |
| 3,931,824 | A | | 1/1976 | Miano et al. |
| 4,108,151 | A | | 8/1978 | Martin et al. |
| 4,109,663 | A | | 8/1978 | Maeda et al. |
| 4,119,104 | A | | 10/1978 | Roth |
| 4,149,549 | A | | 4/1979 | Grossman et al. |
| 4,182,348 | A | | 1/1980 | Seehofer et al. |
| 4,193,412 | A | | 3/1980 | Heim et al. |
| 4,195,645 | A | | 4/1980 | Bradley, Jr. et al. |
| 4,197,861 | A | | 4/1980 | Keith |
| 4,296,762 | A | | 10/1981 | Eicher et al. |
| 4,317,460 | A | | 3/1982 | Dale et al. |
| 4,450,847 | A | | 5/1984 | Owens |
| 4,453,553 | A | | 6/1984 | Cohn |
| RE31,700 | E | | 10/1984 | Yamaguchi |
| 4,489,739 | A | | 12/1984 | Mattina, Jr. et al. |
| 4,744,374 | A | | 5/1988 | Deffeves et al. |
| 4,874,000 | A | | 10/1989 | Tamol et al. |
| 4,881,994 | A | * | 11/1989 | Rudy et al. ..... 149/109.4 |
| 4,956,330 | A | | 9/1990 | Elliott et al. |
| 5,050,621 | A | | 9/1991 | Creighton et al. |
| 5,074,321 | A | | 12/1991 | Gentry et al. |
| 5,101,839 | A | | 4/1992 | Jakob et al. |
| 5,105,836 | A | | 4/1992 | Gentry et al. |
| 5,129,408 | A | | 7/1992 | Jakob et al. |
| 5,143,098 | A | | 9/1992 | Rogers et al. |
| 5,211,684 | A | | 5/1993 | Shannon et al. |
| 5,258,330 | A | | 11/1993 | Khandros et al. |
| 5,258,340 | A | | 11/1993 | Augustine et al. |
| 5,284,166 | A | | 2/1994 | Cartwright et al. |
| 5,322,075 | A | | 6/1994 | Deevi et al. |
| 5,342,484 | A | | 8/1994 | Cutright et al. |
| 5,345,951 | A | | 9/1994 | Serrano et al. |
| 5,386,838 | A | | 2/1995 | Quincy, III et al. |
| 5,388,594 | A | | 2/1995 | Counts |
| 5,474,095 | A | | 12/1995 | Allen et al. |
| 5,499,636 | A | | 3/1996 | Baggett, Jr. et al. |
| 5,591,368 | A | | 1/1997 | Fleischhauer et al. |
| 5,598,868 | A | | 2/1997 | Jakob et al. |

(Continued)

FOREIGN PATENT DOCUMENTS

| | | |
|---|---|---|
| CH | 609217 | 2/1979 |
| DE | 3600462 A1 | 7/1987 |

(Continued)

OTHER PUBLICATIONS

Co-pending U.S. Appl. No. 10/870,449, filed Jun. 14, 2004.

(Continued)

*Primary Examiner* — Richard Crispino
*Assistant Examiner* — Phu Nguyen
(74) *Attorney, Agent, or Firm* — Buchanan Ingersoll & Rooney PC

(57) ABSTRACT

Cigarette paper, methods for making cigarettes and methods for smoking cigarettes are provided, which involve the use of an oxyhydroxide compound that is capable of decomposing to form at least one product capable of acting as an oxidant for the conversion of carbon monoxide to carbon dioxide and/or as a catalyst for the conversion of carbon monoxide to carbon dioxide. The oxyhydroxide compound and/or the product formed from the decomposition of the oxyhydroxide can be in the form of nanoparticles. The oxyhydroxide compounds can be represented by MOOH where M is a metal selected from the group consisting of transition metals, rare earth metals, and mixtures thereof.

53 Claims, No Drawings

(56) References Cited

U.S. PATENT DOCUMENTS

| | | | |
|---|---|---|---|
| 5,666,976 | A | 9/1997 | Adams et al. |
| 5,671,758 | A | 9/1997 | Rongved |
| 5,692,525 | A | 12/1997 | Counts et al. |
| 5,692,526 | A | 12/1997 | Adams et al. |
| 5,728,462 | A | 3/1998 | Arino et al. |
| 5,878,754 | A | 3/1999 | Peterson et al. |
| 5,915,387 | A | 6/1999 | Baggett, Jr. et al. |
| 5,934,289 | A | 8/1999 | Watkins et al. |
| 5,988,176 | A | 11/1999 | Baggett, Jr. et al. |
| 5,997,691 | A | 12/1999 | Gautam et al. |
| 6,026,820 | A | 2/2000 | Baggett, Jr. et al. |
| 6,053,176 | A | 4/2000 | Adams et al. |
| 6,095,152 | A | 8/2000 | Beven et al. |
| 6,138,684 | A | 10/2000 | Yamazaki |
| 6,286,516 | B1 | 9/2001 | Bowen et al. |
| 6,342,191 | B1 | 1/2002 | Kepner et al. |
| 6,371,127 | B1 | 4/2002 | Snaidr et al. |
| 6,478,032 | B1 | 11/2002 | Case et al. |
| 6,769,437 | B2 | 8/2004 | Hajaligol et al. |
| 2001/0032653 | A1 | 10/2001 | Hampl, Jr. |
| 2002/0002979 | A1 | 1/2002 | Bowen et al. |
| 2002/0062834 | A1 | 5/2002 | Snaidr et al. |
| 2002/0157678 | A1 | 10/2002 | Hampl, Jr. |
| 2002/0195115 | A1 | 12/2002 | Meier |
| 2003/0005940 | A1 | 1/2003 | Dyakonov et al. |
| 2003/0037792 | A1 | 2/2003 | Snaidr et al. |
| 2003/0075193 | A1 | 4/2003 | Li et al. |
| 2003/0131859 | A1 | 7/2003 | Li et al. |
| 2003/0188758 | A1* | 10/2003 | Hajaligol et al. ..... 131/364 |
| 2004/0007242 | A1 | 1/2004 | Finlay et al. |
| 2004/0020504 | A1 | 2/2004 | Snaidr et al. |
| 2004/0110633 | A1 | 6/2004 | Deevi et al. |

FOREIGN PATENT DOCUMENTS

| | | | |
|---|---|---|---|
| DE | 3640953 | A1 | 6/1988 |
| FR | 2792547 | A | 10/2000 |
| GB | 562786 | | 7/1944 |
| GB | 685822 | | 1/1953 |
| GB | 863287 | | 3/1961 |
| GB | 908773 | | 10/1962 |
| GB | 914355 | | 1/1963 |
| GB | 973854 | | 10/1964 |
| GB | 1104993 | | 3/1968 |
| GB | 1113979 | | 5/1968 |
| GB | 1315287 | | 5/1973 |
| JP | 35-002900 | | 3/1935 |
| JP | 55-090296 | U | 6/1980 |
| JP | 06105675 | A | 4/1994 |
| JP | 2003129399 | A * | 5/2003 |
| WO | WO 87/06104 | A1 | 10/1987 |
| WO | WO 00/40104 | A1 | 7/2000 |
| WO | WO 02/24005 | A2 | 3/2002 |
| WO | WO03/086112 | A | 10/2003 |

OTHER PUBLICATIONS

Baker et al., "Variation of the Gas Formation Regions within a Cigarette Combustion Coal during the Smoking Cycle", Beiträge zur Tabakforschung International, vol. 11, No. 1, pp. 1-17, (1981), British-American Tobacco Co. Ltd., Southhampton, England.

Baker et al., Mechanism of Smoke Formation and Delivery, Recent Advances in Tobacco Science, vol. 6, pp. 184-224, 34$^{th}$ Tobacco Chemists' Research Conference, Oct. 27-29, 1980, Richmond, VA.

Notification of Transmittal of the International Search Report or the Declaration for PCT/US03/03456 dated. Jun. 4, 2003.

Sakai et al., Thermal Decarbonylation of Catechol, Hydroquinone and Resolsinol, Chemistry Letters, 1976, pp. 1153-1156, Chemical Society of Japan.

Nilsson et al., Direct Probing of the Adsorbate-Substrate Chemical bond Using angle-Dependent X-Ray-Emission Spectroscopy, Physical Review B, Apr. 15, 1995, pp. 10 244-10-247, vol. 51, No. 15, The American Physical Society, USA.

Schlotzhauer et al., Pyrolytic Evaluation of Low Chlorogenic Acid Tobaccos in the Formation of the Tobacco Smoke C0-Carcinogen Catechol, Journal of Analytical & Applied Pyrolysis, 1992, pp. 231-238, vol. 22, Elsevier Science, Netherlands.

Schlotzhauer et al., Pyrolytic Studies on the Origin of Phenolic Compounds in Tobacco Smoke, Tobacco Science, 1981, pp. 6-10, vol. 25, Tobacco Science, USA.

Feng et al., Agglomeration and Phase Transition of a Nanophase Iron Oxide Catalyst, Journal of Catalysis, 1993, pp. 510-519, vol. 143, Academic Press, Inc., San Diego, CA.

Schlotzhauer et al., Pyrolytic Studies on the Contribution of Tobacco Leaf Constituents to the Formation of Smoke Catechols, Journal Agric. Food Chem., 1982, pp. 372-374, vol. 30, Amer. Chem. Society, Washington, DC.

Carmella et al., Roles of Tobacco Cellulose, Sugars, and Chlorogenic Acid as Precursors to Catechol in Cigarette Smoke, Jour. Agric. Food Chem., 1984, pp. 267-273, vol. 32, Amer Chem Society, Wash. DC.

Sharma et al., Effect of Reaction Conditions on Pyrolysis of Chlorogenic Acid, Jour. of Analytical and Applied Pyrolysis, 2002, pp. 281-296, vol. 62, Elsevier, England.

Sakuma et al., Pyrolysis of Chlorogenic Acid and Rutin, Agric. Biol. Chem., 1982, pp. 1311-1317, vol. 46, , Nippon Nogei Kagakkai, Agricultural Chemical Society of Japan.

Zhao et al., Structure of a Nanophase Iron Oxide Catalyst, Journal of Catalysis, 1993, pp. 499-509, vol. 143, Academic Press, Inc. USA.

Ellg et al., Pyrolysis of Volatile Aromatic Hydrocarbons and *n*-Heptane over Calcium Oxide and Quartz, Ind. Eng Chem. Proces Des. Dev., 1985, pp. 1080-1087, vol. 24, American Chemical Society, Washington, DC.

Smith et al., The Relative Toxicity of Substitued Phenols Reported in Cigarette Mainstream Smoke, Toxicological Sciences, 2002, pp. 265-278, vol. 69, Society of Toxiclogy , Oxford Univ Press.

Hopkinson et al., Nonlinear Island Growth Dynamics in Adsorbate-Induced Restructuring of Quasihexagonal Reconstructed Pt (100) by CO., Physical Review Letters, Sep. 6, 1993, pp. 1597-1600, vol. 71, No. 10, American Physical Society, USA.

Yeo et al., Calorimetric Measurement of the Energy Difference Between Two solid Surface Phases, Science, Jun. 23, 1995, pp. 1731-1732, vol. 268.

Gruyters et al., Modelling Temporal Kinetic Oscillations for CO Oxidation on Pt (100). The (1×1)-CO Island Growth Rate Power Law Model, Chemical Physics Letters, Jan. 6, 1995, pp. 1-6, vol. 232, Elsevier Science, Oxford, England.

Cant et al., Silver and Gold Catalyzed Reactions of Carbon Monoxide with Nitric Oxide and with Oxygen, Journal of Catalysis, 1975, pp. 531-539, vol. 37, Academic Press, Inc., USA.

Xia et al., Efficient Stable Catalysts for Low Temperature Carbon Monoxide Oxidation, Journal of Catalysis, 1999, pp. 91-105, vol. 185, Academic Press, Inc., USA.

Randall et al., Reduction of Nitrogen Oxides by Carbon Monoxide Over an Iron Oxide Catalyst Under Dynamic Conditions, Applied Catalysis B: Environmental, 1998, pp. 357-369, vol. 17, Elsevier Science, England.

Lanzillotti et al., One-Dimensional Gas Concentration Profiles Within a Burning Cigarette During a Puff, Beitrage zur Tabakforschung, 1975, pp. 219-224, vol. Band 8, Heft 4.

Li et al., The Removal of Carbon Monoxide by iron Oxide Nanoparticles, Applied Catalysis B: Environmental, 2002, pp. 1-12, vol. 1326, Elsevier Science, England.

Baker, The Formation of the Oxides of Carbon by the Pyrolysis of Tobacco, Beitrage zur Tabakforschung, 1975, pp. 16-27, vol. Band 8, Heft 1.

Shen et al., Cu Containg Octahedral Molecular Sieves and Octahedral Layered Materials, Journal of Catalysis, 1996, pp. 115-122, vol. 161, Article No. 168, Academic Press, Inc. USA.

Brage et al., Tar Evolution Profiles Obtained from Gasification of Biomass and Coal, Biomass & Bioenergy, 2000, pp. 87-91, vol. 18, Elsevier, England.

Brage et al., Characteristics of Evolution of Tar from Wood Pyrolysis in a Fixed-Bed Reactor, FUEL, 1996, pp. 213-219, vol. 75 No. 2, Elsevier Sci Ltd., England.

(56) References Cited

OTHER PUBLICATIONS

Rath et al., Tar Cracking from Fast Pyrolysis of Large Beech Wood Particles, Journal of Analytical & Applied Pyrolysis, 2002, pp. 83-92, vol. 62, Elsevier, England.
Hasler et al., Sampling and Analysis of Particles and Tars from Biomass Gasifiers, Biomass & Bioenergy, 2000, pp. 61-66, vol. 18, Elsevier, England.
Wornat et al., Polycyclic Aromatic Hydrocarbons from the Pyrolysis of Catechol (ortho-dihydroxybenzene), a Model Fuel Representative of Entities in Tobacco, Coal & Lignin, FUEL, 2001, pp. 1711-1726, vol. 80, Elsevier, England.
Windig, Chemical Interpretation of Differences in Pyrolysis-Mass Spectra of Simulated Mixtures of Biopolymers by Factor Analysis with Graphical Rotation, Journal of Analytical & Applied Pyrolysis, 1981/1982, pp. 199-212, vol. 3 Elsevier Scientific Pub Co., Netherlands.
Walker et al., Carbon Monoxide & Propene Oxidation by Iron Oxides for Auto-Emission Control, Journal of Catalysis, 1988, pp. 298-209, vol. 110, Academic Press, Inc., USA.
Colussi et al., The Very Low-Pressure Pyrolysis of Phenyl Ethyl Ether, Phenyl Allyl Ether, & Benzyl Methyl Ether & the Enthalpy of Formation of the Phenoxy Radical, International Journal of Chemical Kinetics, 1977, pp. 161-178, vol. IX, John Wiley & Sons, Inc., USA.
Windig et. al., Interactive Self-Modeling Multivariate Analysis, Chemometrics & Intelligent Laboratory Systems, 1990, pp. 7-30, vol. 9, Elsevier Sci Pub, B.V., Amsterdam, Netherlands.
Lovell et al., The Gas Phase Pyrolysis of Phenol, Intl Journal of Chemical Kinetics, 1989, pp. 547-560, vol. 21, John Wiley & Sons, Inc. USA.
Rath et al., Cracking Reactions of Tar from Pyrolysis of Spruce Wood, FUEL, 2001, pp. 1379-1389, vol. 80, Elsevier Science Ltd., Elsevier.
Wong at al., In-Situ Study of MCM-41-Supported Iron Oxide Catalysts by XANES & EXAFS, Applied Catalysis A: General, 2000, pp. 115-126, vol. 198, Elsevier Science B.V.
Haruta et al., Synergism in the Catalysis of Supported Gold, New Aspects of Spillover Effect in Catalysis, 1993, pp. 45-52, Elsevier Science Publishers B.V.
Fohlisch et al., The Bonding of CO to Metal Surfaces, Journal of Chemical Physics, 2000, pp. 1946-1958, vol. 112, No. 4, American Institute of Physics, USA.
Hauert et al., CO Adsorption on Glassy $Ni_{64}Zr_{36}$ and Polycrystalline $Ni_3Zr$, Rapidly Quenched Metals, 1985, pp. 1493-1496, Elsevier Science Publishers B.V.
Baiker, Glassy Metals in Catalysis, Applied Physics, 1994, pp. 122-162, vol. 72, Springer-Verlag Berlin Heidelberg, Germany.
Haruta et al., Preparation of Highly Active Composite Oxides of Silver for Hydrogen & Carbon Monoxide Oxidation, Preparation of Catalysts III, 1983, pp. 225-236, Elsevier Science Pub. B.V., Netherlands.
Shin et al., The Formation of Aromatics from the Gas-Phase Pyrolysis of Stigmasterol: Kinetics, FUEL 2001, pp. 1681-1687, vol. 80, Elsevier Science Ltd. , England.
Yeboah et al., Pyrolytic Desulfurization of Coal in Fluidized Beds of Calcined Dolomite, Ind. Eng. Chemical Process Des. Dev, 1982, pp. 324-330, vol. 21, American Chemical Society, USA.
Galvagno et al., Oxygen Transfer Between CO & $CO_2$ Catalyzed by Supported Au, Pt, and Au-Pt, Ber. Bunsenger Physical Chemical, 1979, pp. 894-899, vol. 83, Verlag Chemie, Germany.
Cha et al., Surface Reactivity of Supported Gold, Journal of Catalysis, 1970, pp. 200-211, vol. 18, Elsevier Science.
Baiker at al., Transformation of Glassy Palladium-Zirconium Alloys to Highly Active CO-Oxidation Catalysts During In situ Activation Studied by Thermooanalytical Methods & X-Ray Diffraction, Ber. Bunsenges. Phys. Chem, 1993, pp. 286-292, vol. 97, No. 3, VCH Verlagsgesellschaft mbH.
Blyholder, Molecular Orbital View of Chemisorbed Carbon Monoxide, Journal of Physical Chemistry, 1964, pp. 2772-2778, vol. 68, No. 10, American Chemical Society.
Nilsson et al., An Atom-Specific Look at the Surface Chemical Bond, Physical Review Letters, 1997, pp. 2847-2850, vol. 78, No. 14, American Physical Society, USA.
Evans et al., Molecular Characterization of the Pyrolysis of Biomass. 1 Fundamentals, Energy & Fuels, An American Chemical Society Journal, 1987, pp. 123-137, vol. 1, No. 2, American Chemical Society.
Fohlisch et al., How Carbon Monoxide Adsorbs in Different Sites, Physical Review Letters, 2000, pp. 3309-3312, vol. 85, No. 15, American Physical Society, USA.
Fohlisch et al., Ground-State Interpretation of X-Ray Emission Spectroscopy on Adsorbates: CO Adsorbed on Cu(100), Physical Review B, 2000, pp. 16229-16240, vol. 61, No. 23, American Physical Society, USA.
Baker, Combustion and Thermal Decomposition Regions Inside a Burning Cigarette, Combustion & Flame, 1977, pp. 21-32 , vol. 30, Combustion Institute, Elsevier North-Holland, Inc.
Gardner et al., Catalytic Behavior of Nobel Metal/Reducible Oxide Materials for Low-Temperature CO Oxidation. 1. Comparison of Catalyst Performance, Langmuir, 1991, pp. 2135-2139, vol. 7, American Chemical Society.
Daglish et al., The Carbon Monoxide-Oxygen Reaction on Palladium Gold Alloys, Proceedings of $2^{nd}$ Int Congress of Catalysis, 1961, pp. 1615-1626, vol. 79.
Yeboah et al., Effect of Calcined Dolomite on the Fluidized Bed Pryolysis of Coal, Ing. Eng. Chem. Process Des. Dev, 1980, pp. 646-653, vol. 19, American Chemical Society.
Chen, NEXAFS Investigations of Transition Metal Oxides, Nitrides, Carbides, Sulfides & Other Interstitial Compounds, Surface Science Reports, 1997, pp. 1-152, vol. 30, Elsevier.
Shin et al., A Study of the Mechanisms of Vanillin Pyrolysis by Mass Spectrometry & Multivariate Analysis, FUEL, 2001, pp. 1689-1696, vol. 80, Elsevier Science Ltd.
Shin at al., Kinetic Analysis of the Gas-Phase Pyrolysis of Carbohydrates, FUEL, 2001, pp. 1697-1709, vol. 80, Elsevier Science Ltd.
Hesp et al., Thermal Cracking of Tars & Volatile Matter from Coal Carbonization, Ind. Eng. Chem. Prod. Res. Develop, 1970, pp. 194-202, vol. 9, No. 2, American Chemical Society.
He et al., Kinetics of Hydrogen & Hydroxyl Radical Attack on Phenol at High Temperatures, Journal Physical Chemistry, 1988, pp. 2196-2201, vol. 92, American Chemical Society, USA.
Cypres et al. Mecanismes De Fragmentation Pyrolytique Du Phenol Et Des Cresols, Tetrahedron, 1974, pp. 1253-1260, vol. 30, Pergamon Press, Great Britain.
Cypres et al., Pyrolyse Thermique Des $\{^{14}C\}$ ET $\{^{3}H\}$ Ortho Et Para-Cresols, Tetrahedron, 1975, pp. 353-357, vol. 31 Pergamon Press, Great Britain.
Windig at al., Nonsupervised Numerical Component Extraction from Pyrolysis Mass Spectra of Complex Mixtures, Analytical Chemistry, 1984, pp. 2297-2303, vol. 56, American Chemical Society, USA.
Windig et al., Interpretation of Sets of Pyrolysis Mass Spectra by Discriminant Analysis & Graphical Rotation, Analytical Chemistry, 1983, pp. 81-88, vol. 55, American Chemical Society, USA.
Tillborg et al. Studies of the Co-H,H2-Ni(100) System Using Photoelectron Spectroscopy, Surface Science, 1992, pp. 47-60, vol. 273, Elsevier Science Publishers B.V.
Westerlund et al., Hydrogen Recombination & Σ-Desorption from the Ni(100)-H-CO Coadsorption System, Surface Science, 1988, pp. 109-120, Elsevier Science Publishers B.V., North-Holland Physics Publishing Division, Holland.
Imura et al., Oxidation of Carbon Monoxide Catalyzed by Manganese-Silver Composite Oxides, Journal of Catalysis, 1988, pp. 198-205, vol. 109, Academic Press, Inc.
Haruta et al., Gold Catalysts Prepared by Coprecipitation for Low-Temperature Oxidation of Hydrogen and of Carbon Monoxide, Journal of Catalysis, 1989, pp. 301-309, vol. 115, Academic Press, Inc.
Imamura et al., Cooperative Action of Palladium and Manganese(III) Oxide in the Oxidation of Carbon Monoxide, Journal of Catalysis, 1995, pp. 279-284, vol. 151, Academic Press, Inc.
Kim et al., Controlling Chemical Turbulence by Global Delayed Feedback: Pattern Formation in Catalytic CO Oxidation on Pt(110), Science, May 18, 2001, pp. 1357-1360, vol. 292, Science Magazine.

(56) References Cited

OTHER PUBLICATIONS

Boccuzzi et al., FTIR Study of Co Oxidation on $Au/TiO_2$ at 90 K and Room Temperature. An Insight into the Nature of the Reaction Centers, Journal of Physical Chemistry B, 2000, pp. 5414-5416, , vol. 104, American Chemical Society, USA.
Baiker et al. , Carbon Monoxide Oxidation over Catalysts Prepared by in Situ Activation of Amorphous Gold-Silver-Zirconium and Gold-Iron-Zirconium Alloys, Journal of Catalysis, 1995, pp. 407-419, vol. 151, Academic Press, Inc.
Haruta et al., Low-Temperature Oxidation of CO over Gold Supported on $TiO_2$, $\propto$-$Fe_2O_3$, and $Co_3O_4$ Journal of Catalysis, 1993, pp. 175-192, vol. 144, Academic Press, Inc.
Kobayashi et al., A Selective CO Sensor Using Ti-Doped $\propto$-$Fe_2O_3$ with Coprecipitated Ultrafine Particles of Gold, Sensors and Actuators, 1988, pp. 339-349, vol. 13, Elsevier Sequoia, Netherlands.
Baker, A Review of Pyrolysis Studies to Unravel Reaction Steps in Burning Tobacco, Journal of Analytical and Applied Pyrolysis, 1987, pp. 555-573, vol. 11, Elsevier Science Publishers B.V., Netherlands.
Schimanke et al., In Situ XRD Study of the Phase Transition of Nanocrystalline Maghemite ($\nu$-$Fe_2O_3$) to Hematite ($\propto$-$Fe_2O_3$) Solid State Ionics, 2000, pp. 1235-1240, vol. 136-137, Elsevier Science B.B.
Miser et al., Evidence of the Mechanisms of Catalysis and Deactivation of a Nanoparticle Iron Oxide, Submitted to Applied Catalysis A, Apr. 2003.
Rostami et al., Formation and Reduction of Carbon Monoxide in a Burning Cigarette, Accepted for Publication by Beitrage zur Tabakforschung, Apr. 2003.
Li et al., The Catalytic/Oxidative Effects of Iron Oxide Nanoparticles on Carbon Monoxide and the Pyrolytic Products of Biomass Model Compounds, Nanotechnology in Catalysis, Kluwer Academic/Plenum.
Baker, The Effect of Ventilation on Cigarette Combustion Mechanisms, Recent Advances in Tobacco Science, 1984, pp. 88-150, vol. 10.
Shin et al., Heterogeneous Cracking of Catechol Under Partially Oxidative Conditions, Submitted to FUEL.
Shin et al., Characterizing Biomatrix Materials Using Pyrolysis Molecular Beam Mass Spectrometer and Pattern Recognition, Submitted to Journal of Analytical & Applied Pyrolysis, Elsevier.
Bone et al., Studies Upon Catalytic Combustion.-Part I. the Union of Carbon Monoxide and Oxygen in Contact with a Gold Surface, Proc. Royal Society (London) 1925, pp. 459-476, vol. A 109, England.
Li et al., Application of Nanoparticle Iron Oxide in Cigarette for Simultaneous CO and NO Removal in the Mainstream Smoke, Submitted to Beitrage for review and Publication , Feb. 2003.
Robie et al., Thermodynamic Properties of Minerals and Related Substances at 298.15 K and 1 Bar ($10^5$ pascals) Pressure and at Higher Temperatures, U.S. Geological Survey Bulletin, 1984.
Eichler et al., Reaction Channels for the Catalytic Oxidation of CO on Pt(111), Physical Review B, 1999, pp. 5960-5967, vol. 58, No. 8, The American Physical Society, USA.
C.S. Lai et al., Thermal Reactions of m-cresol Over Calcium Oxide Between 350 and 600° C. FUEL, 1987, pp. 525-531, vol. 66, Butterworth & Co (Publishers) Ltd.
Cornell et al., The Iron Oxides, Structure, Properties, Reactions, Occurrence and Uses, Book, 1996, VCH Verlagsgesellschaft, Weinheim, Germany.
King, The Chemical Physics of Solid Surfaces and Heterogeneous Catalysis, vol. 3, Chemisorption Systems Part A & Part B, 1990, Book, Elsevier Science Publishers B.V., Netherlands.
Lide, CRC Handbook of Chemistry & Physics, A Ready-Reference book of Chemical & Physical Data, 2000-2001, pp. 6-2, 81st Edition, CRC Press, USA.
Im et al., Formation of Nitric Oxide During Tobacco Oxidation, Submitted to the Journal of Agricultural & Food Chemistry May 2003.
Li et al., The Removal of Carbon Monoxide by Iron Oxide Nanoparticles, Applied Catalysis B: Environmental, 2003, pp. 151-162, vol. 43, Elsevier Science B.V.
Hopkinson et al., Surface Restructuring Dynamics in CO Adsorption, Desorption, and reaction with NO on Pt(100), Chemical Physics, 1993, pp. 433-452, vol. 177, Elsevier Science Publishers B.V., North-Holland.
Schlogl et al., Oxidation of Carbon Monoxide over Palladium on Zirconia Prepared from Amorphous Pd-Zr alloy, Journal of Catalysis, 1992, pp. 139-157, vol. 137, Academic Press, Inc.
Bond, Catalysis by Gold, Catalysis. Review- Science Eng., 1999, pp. 319-388, vol. 41 (3&4), Marcel Dekker, Inc.
Knacke et al., Thermochemical Properties of Inorganic Substances, 1991, vol. 1 & 2 , 2nd Edition, Sprimger-Verlag, Berlin.
Miser et al., High-Resolution TEM Characterization of Iron Oxide Catalyst and Reaction Products, ACS Symposium. Catl 19.
Evans et al., Chemistry of Tar Formation and Maturation in the Thermochemical Conversion of Biomass, Fuel & Energy Abstracts May 1998, pp. 197, vol. 39, Alternative Energy Sources.
International Preliminary Report on Patentability for PCT/1B2004/003639 dated May 1, 2006.
Notification of Transmittal of the International Search Report and the Written Opinion of the International Searching Authority, or the Declaration for PCT/IB2004/003639 dated Jun. 2, 2005.

* cited by examiner

USE OF OXYHYDROXIDE COMPOUNDS IN CIGARETTE PAPER FOR REDUCING CARBON MONOXIDE IN THE MAINSTREAM SMOKE OF A CIGARETTE

This application claims priority under 35 U.S.C. §119 to U.S. Provisional Application No. 60/514,529 entitled USE OF OXYHYDROXIDE COMPOUNDS IN CIGARETTE PAPER FOR REDUCING CARBON MONOXIDE IN THE MAINSTREAM SMOKE OF A CIGARETTE, filed Oct. 27, 2003, the entire content of which is hereby incorporated by reference.

BACKGROUND

Various methods for reducing the amount of carbon monoxide in the mainstream smoke of a cigarette during smoking have been proposed.

Despite the developments to date, there remains an interest in improved and more efficient methods and compositions for reducing the amount of carbon monoxide in the mainstream smoke of a cigarette during smoking. Preferably, such methods and compositions should not involve expensive or time consuming manufacturing and/or processing steps. More preferably, it should be possible to catalyze or oxidize carbon monoxide along the length of the cigarette during smoking.

SUMMARY

Cigarette wrappers, cut filler compositions, cigarettes, methods for making cigarettes and methods for smoking cigarettes that involve the use of an oxyhydroxide compound are provided. The oxyhydroxide compound is represented by MOOH where M is a metal selected from the group consisting of transition metals, rare earth metals, and mixtures thereof, and is capable of decomposing to form at least one product capable of acting as an oxidant for the conversion of carbon monoxide to carbon dioxide and/or as a catalyst for the conversion of carbon monoxide to carbon dioxide.

In one embodiment, a cigarette wrapper paper comprises a cellulosic component and a filler comprising an oxyhydroxide compound, wherein the oxyhydroxide compound is represented by MOOH where M is a metal selected from the group consisting of transition metals, rare earth metals, and mixtures thereof, and wherein during combustion of the cigarette wrapper paper, said oxyhydroxide compound is capable of decomposing to form at least one product capable of acting as an oxidant for conversion of carbon monoxide to carbon dioxide and/or as a catalyst for conversion of carbon monoxide to carbon dioxide.

A preferred cigarette wrapper paper comprises a cellulosic component and an oxyhydroxide compound, wherein the oxyhydroxide compound is represented by MOOH where M is a metal selected from the group consisting of Fe, Ti, and mixtures thereof, wherein during combustion of the cigarette wrapper paper, said oxyhydroxide compound is capable of decomposing to form at least one product capable of acting as an oxidant for conversion of carbon monoxide to carbon dioxide and/or as a catalyst for conversion of carbon monoxide to carbon dioxide, and wherein the oxyhydroxide compound and/or the product formed from the decomposition of the oxyhydroxide has an average particle size of greater than one micron to less than three microns.

Oxyhydroxide compounds include, but are not limited to: FeOOH, TiOOH, and mixtures thereof, with FeOOH being particularly preferred. Preferably, the oxyhydroxide compound is capable of decomposing to form at least one decomposition product, such as $Fe_2O_3$, $TiO_2$, and mixtures thereof, that can convert carbon monoxide to carbon dioxide and is present in an amount effective to convert at least 15% of the carbon monoxide to carbon dioxide.

DETAILED DESCRIPTION

Cigarette wrappers, cut filler compositions, cigarettes, methods for making cigarettes and methods for smoking cigarettes are provided which involve the use of an oxyhydroxide compound that is capable of decomposing during smoking to form at least one product capable of acting as an oxidant for the conversion of carbon monoxide to carbon dioxide and/or as a catalyst for the conversion of carbon monoxide to carbon dioxide. The amount of carbon monoxide in mainstream smoke can be reduced, thereby also reducing the amount of carbon monoxide reaching the smoker and/or given off as second-hand smoke.

The term "mainstream" smoke refers to the mixture of gases passing down the tobacco rod and issuing through the filter end, i.e. the amount of smoke issuing or drawn from the mouth end of a cigarette during smoking of the cigarette. The mainstream smoke contains smoke that is drawn in through both the lit region of the cigarette, as well as through the cigarette paper wrapper.

The total amount of carbon monoxide present in mainstream smoke and formed during smoking comes from a combination of three main sources: thermal decomposition (about 30%), combustion (about 36%) and reduction of carbon dioxide with carbonized tobacco (at least 23%). Formation of carbon monoxide from thermal decomposition starts at a temperature of about 180° C., and finishes at around 1050° C., and is largely controlled by chemical kinetics. Formation of carbon monoxide and carbon dioxide during combustion is controlled largely by the diffusion of oxygen to the surface ($k_a$) and the surface reaction ($k_b$). At 250° C., $k_a$ and $k_b$, are about the same. At 400° C., the reaction becomes diffusion controlled. Finally, the reduction of carbon dioxide with carbonized tobacco or charcoal occurs at temperatures around 390° C. and above. Besides the tobacco constituents, the temperature and the oxygen concentration are the two most significant factors affecting the formation and reaction of carbon monoxide and carbon dioxide.

While not wishing to be bound by theory, it is believed that the oxyhydroxide compounds decompose under conditions for the combustion of the cut filler or the smoking of the cigarette to produce either catalyst or oxidant compounds, which target the various reactions that occur in different regions of the cigarette during smoking. During smoking there are three distinct regions in a cigarette: the combustion zone, the pyrolysis/distillation zone, and the condensation/filtration zone. First, the "combustion zone" is the burning region of the cigarette, produced during smoking of the cigarette, usually at the lit end of a cigarette. The temperature in the combustion zone ranges from about 700° C. to about 950° C., and the heating rate can go as high as 500° C./second. The concentration of oxygen is low in this region, since it is being consumed in the combustion of tobacco to produce carbon monoxide, carbon dioxide, water vapor, and various organics. This reaction is highly exothermic and the heat generated here is carried by gas to the pyrolysis/distillation zone. The low oxygen concentrations coupled with the high temperature in the combustion zone leads to the reduction of carbon dioxide to carbon monoxide by the carbonized tobacco. In the combustion zone, it is desirable to use an oxyhydroxide that decomposes to form an oxidant in situ, which will convert carbon monoxide to carbon dioxide in the absence of oxygen.

The oxidation reaction begins at around 150° C., and reaches maximum activity at temperatures higher than about 460° C.

Next, the "pyrolysis zone" is the region behind the combustion zone, where the temperatures range from about 200° C. to about 600° C. This is where most of the carbon monoxide is produced. The major reaction in this region is the pyrolysis (i.e. the thermal degradation) of the tobacco that produces carbon monoxide, carbon dioxide, smoke components, and charcoal using the heat generated in the combustion zone. There is some oxygen present in this zone, and thus it is desirable to use an oxyhydroxide that decomposes to produce a catalyst in situ for the oxidation of carbon monoxide to carbon dioxide. The catalytic reaction begins at 150° C. and reaches maximum activity around 300° C. In a preferred embodiment, the catalyst may also retain oxidant capability after it has been used as a catalyst, so that it can also function as an oxidant in the combustion zone as well.

Finally, there is the "condensation zone", where the temperature ranges from ambient to about 150° C. The major process in this region is the condensation/filtration of the smoke components. Some amount of carbon monoxide and carbon dioxide diffuse out of the cigarette and some oxygen diffuses into the cigarette. However, in general, the oxygen level does not recover to the atmospheric level.

In commonly-assigned U.S. Patent Application Publication 2003/0075193 entitled "Oxidant/Catalyst Nanoparticles to Reduce Carbon Monoxide in the Mainstream Smoke of a Cigarette", and in commonly-assigned U.S. Patent Application Publication 2003/0188758 entitled "Use of Oxhydroxide Compounds for Reducing Carbon Monoxide in the Mainstream Smoke of a Cigarette", various oxidant/catalyst nanoparticles are described for reducing the amount of carbon monoxide in mainstream smoke. The disclosures of these applications are hereby incorporated by reference in their entirety. While the use of these catalysts reduces the amount of carbon monoxide in mainstream smoke during smoking, it is further desirable to minimize or prevent contamination and/or deactivation of catalysts used in the cigarette filler, particularly over long periods of storage. One potential way of achieving this result is to use an oxyhydroxide compound to generate the catalyst or oxidant in situ during smoking of the cigarette. For instance, FeOOH decomposes to form $Fe_2O_3$ and water at temperatures typically reached during smoking of the cigarette, e.g. above about 200° C.

By "oxyhydroxide" is meant a compound containing a hydroperoxo moiety, i.e. "—O—O—H". One example of oxyhydroxides include, but are not limited to: FeOOH, and TiOOH. Another example of oxyhydroxides include MOOH where M is a metal selected from the group comprising of, consisting of or consisting essentially of transition metals, rare earth metals, and mixtures thereof. For example, preferred metals include a group IVB or a group VIII metal. More preferably, the metal is selected from the group comprising of, consisting of or consisting essentially of Fe, Ti, and mixtures thereof.

Any suitable oxyhydroxide compound may be used, which is capable of decomposing, under the temperature conditions achieved during smoking of a cigarette, to produce compounds which function as an oxidant and/or as a catalyst for converting carbon monoxide to carbon dioxide. In a preferred embodiment, the oxyhydroxide forms a product that is capable of acting as both an oxidant for the conversion of carbon monoxide to carbon dioxide and as a catalyst for the conversion of carbon monoxide to carbon dioxide. It is also possible to use combinations of oxyhydroxide compounds to obtain this effect and/or to use oxyhydroxides in combination with other oxidants and/or catalysts, such as oxyhydroxide in combination with metal oxides, e.g., iron oxides. Preferably, the selection of an appropriate oxyhydroxide compound will take into account such factors as stability and preservation of activity during storage conditions, low cost and abundance of supply.

Preferred oxyhydroxide compounds are stable when present in cigarette wrappers, e.g., cigarette paper or other paper used in the manufacture of smoking articles such as cigarettes, cut filler compositions or in cigarettes, at typical room temperature and pressure, as well as under prolonged storage conditions. Preferred oxyhydroxide compounds include inorganic oxyhydroxide compounds that decompose during smoking of a cigarette, to form metal oxides. For example, in the following reaction, M represents a metal:

$$2M—O—O—H \rightarrow M_2O_3 + H_2O$$

Optionally, one or more oxyhydroxides may also be used as mixtures or in combination, where the oxyhydroxides may be different chemical entities or different forms of the same metal oxyhydroxides. A preferred oxyhydroxide compound is aluminum-free and includes FeOOH, TiOOH, and mixtures thereof, with FeOOH being particularly preferred. Another preferred oxyhydroxide compound includes MOOH where M is a metal selected from the group consisting of transition metals, rare earth metals, and mixtures thereof. For example, preferred metals include a group IVB or a group VIII metal. More preferably, the metal is selected from the group consisting of Fe, Ti, and mixtures thereof. Other preferred oxyhydroxide compounds include those that are capable of decomposing to form at least one product selected from the group consisting of metal oxides. For example, the decomposition product can include $Fe_2O_3$, $TiO_2$, and mixtures thereof. Of course, one of ordinary skill in the art will appreciate that the decomposition product will depend upon the oxyhydroxide compound selected. Particularly preferred oxyhydroxides include FeOOH, particularly in the form of α-FeOOH (goethite); however, other forms of FeOOH such as γ-FeOOH (lepidocrocite), β-FeOOH (akaganeite), and δ'-FeOOH (feroxyhite) may also be used. The oxyhydroxide compound may be made using any suitable technique, or purchased from a commercial supplier, such as Aldrich Chemical Company, Milwaukee, Wis.

FeOOH is preferred because it produces $Fe_2O_3$ upon thermal degradation. $Fe_2O_3$ is a preferred catalyst/oxidant because it is not known to produce any unwanted byproducts, and will simply be reduced to FeO or Fe after the reaction. In addition, use of a precious metal can be avoided, as both $Fe_2O_3$ and $Fe_2O_3$ nanoparticles are economical and readily available. Moreover, $Fe_2O_3$ is capable of acting as both an oxidant for the conversion of carbon monoxide to carbon dioxide and as a catalyst for the conversion of carbon monoxide to carbon dioxide.

If desired, the cigarette wrapper can further include one or more optional metal oxides, such as iron oxides, may be used alone or in combination with other oxides or oxyhydroxides. A preferred metal oxide is iron oxide. More preferably, the metal oxide is γ-$Fe_2O_3$. The γ-$Fe_2O_3$ is in the form of particles having a particle size less than or equal to 1 micron, preferably having a particle size of less than or equal to 100 nanometers (nm). The metal oxide may additionally be mixed with or supported on a paper filler material, e.g., a filler material used in the production of paper. An example of a paper filler material is calcium carbonate, although other paper filler materials may be used such as $TiO_2$, $SiO_2$, $Al_2O_3$, $MgCO_3$, MgO and $Mg(OH)_2$ and mixtures thereof. The oxyhydroxide compound and optional metal oxide may be present in the paper at a total loading of up to 60 weight percent (wt. %) of the paper, preferably from 15 wt. % to 50 wt. %. When mixed with or supported on a paper filler material, the oxyhydroxide compound and optional metal oxide is present in the cigarette wrapper paper at a loading of up to 60 wt. % of the paper, preferably from 15 wt. % to 50 wt. %, and the ratio of wt. % iron oxide to wt. % paper filler in the cigarette wrapper paper is from 1:9 to 9:1, preferably from 1:4 to 4:1, more preferably about 1:1.

Table 1 shows results for cigarette parameters for cigarette paper having a filler loading of 30 wt. %, wherein a control cigarette has only $CaCO_3$ filler in the paper. One sample has only FeOOH as the filler and one sample has a 50:50 mixture of FeOOH and $CaCO_3$ as the filler. Also shown are parameters for cigarette paper using a 50:50 wt. % mixture of 3 nm $Fe_2O_3/CaCO_3$ (calcined at 300° C.) (the $Fe_2O_3$ can be, for example, NANOCAT®) and a 50:50 wt. % mixture of 20 nm gamma $Fe_2O_3/CaCO_3$ (noncalcined). The cigarettes are handmade using 35 g/m$^2$ paper with 30% filler loading and having a permeability of the wrapper of 33 CU (CORESTA UNITS) (CORESTA, is defined as the amount of air, measured in cubic centimeters, that passes through one square centimeter of material in one minute at a pressure drop of 1.0 kilopascals). The values in Table 1 represent the average of 20 test samples.

TABLE 1

Cigarette Parameters for Cigarette Paper using 30 wt. % Filler

| Paper Filler | Puff Count | CO (mg) | Tar (mg) | CO:Tar | % reduction in CO:Tar from Control |
|---|---|---|---|---|---|
| $CaCO_3$ (control) | 8.2 | 16.6 | 18.1 | 0.92 | — |
| FeOOH (1 micron) | 8.2 | 8.6 | 13.3 | 0.65 | 29 |
| 50:50 wt. % FeOOH (1 micron)/$CaCO_3$, non-calcined | 8.2 | 11.2 | 16.1 | 0.69 | 25 |
| 50:50 wt. % 20 nm gamma-$Fe_2O_3/CaCO_3$ (non-calcined) | 9.3 | 11.0 | 16.5 | 0.67 | 27 |
| 50:50 wt. % 3 nm $Fe_2O_3/CaCO_3$ (calcined at 300° C.) | 8.4 | 7.6 | 12.2 | 0.62 | 33 |

The oxyhydroxide compounds (or the oxyhydroxide compounds and the optional materials described herein) can be incorporated into the cigarette paper during the manufacturing process. For example, the oxyhydroxide compounds can be incorporated in the wrapper through conventional papermaking processes. The oxyhydroxide compounds can be used as all or part of a filler material in the papermaking processes or can be distributed directly onto the wrapper, such as by spraying or coating onto wet or dry base web. In production of a smoking article such as a cigarette, the wrapper is wrapped around cut filler to form a tobacco rod portion of the smoking article by a cigarette making machine, which has previously been supplied or is continuously supplied with tobacco cut filler and one or more ribbons of wrapper.

A wrapper can be any wrapping surrounding the cut filler, including wrappers containing flax, hemp, kenaf, esparto grass, rice straw, cellulose and so forth. Optional filler materials, flavor additives, and burning additives can be included. When supplied to the cigarette making machine, the wrapper can be supplied from a single bobbin in a continuous sheet (a monowrap) or from multiple bobbins (a multiwrap, such as a dual wrap from two bobbins). Further, the wrapper can have more than one layer in cross-section, such as in a bilayer paper as disclosed in commonly-owned U.S. Pat. No. 5,143,098, issued to Rogers, the entire content of which is herein incorporated by reference.

The papermaking process can be carried out using conventional paper making equipment. An exemplary method of manufacturing paper wrapper, e.g., cigarette paper including oxyhydroxide compounds, comprises supplying the oxyhydroxide compounds and a cellulosic material to a papermaking machine. For example, an aqueous slurry (or "furnish") including the oxyhydroxide compounds and the cellulosic material can be supplied to a head box of a forming section of a Fourdrinier papermaking machine. The aqueous slurry can be supplied to the head box by a plurality of conduits which communicate with a source, such as a storage tank.

The oxyhydroxide compounds can be supplied to the papermaking process in any suitable form, such as in the form of an aqueous slurry or in the form of a dry powder to be slurried during the papermaking process prior to addition to the head box. For example, the oxyhydroxide compounds can be produced on site as a slurry. The aqueous slurry containing the oxyhydroxide compounds can be used immediately or stored for future use. In a preferred embodiment, the head box is supplied with an aqueous slurry of furnish containing the oxyhydroxide compounds and cellulosic material used to form a web. Optionally, an aqueous slurry of furnish containing oxyhydroxide compounds and an aqueous slurry furnish of cellulosic material without oxyhydroxide compounds or with a different concentration of oxyhydroxide compounds can be supplied to separate head boxes or multiple head boxes.

An exemplary method deposits the aqueous slurry from the head box onto a forming section so as to form a base web of the cellulosic material and the catalyst modified web-filler. For example, in a typical Fourdrinier machine, the forming section is a Fourdrinier wire which is arranged as an endless forming wire immediately below the head box. A slice defined in a lower portion of the head box adjacent to the endless wire permits the aqueous slurry of oxyhydroxide compounds and cellulosic material from the head box to flow through the slice onto the top surface of the endless wire to form a wet base web. Optionally, the aqueous slurry can be deposited onto a support web that is retained within the paper. For example, a support web can be transported through the forming section of a papermaking machine and can be a foundation on which the aqueous slurry is deposited. The aqueous slurry dries on the Fourdrinier wire in the forming section to an intermediate web, which may still retain an aqueous component, and is further processed to form a paper sheet (e.g., finished web) with the support web embedded therein. The support web can be a conventional web, such as a flax support web, or can include a web with an incorporated oxyhydroxide compound. If the support web includes an oxyhydroxide compound, the incorporated oxyhydroxide compound can be directly supported on the support web.

After depositing the aqueous slurry onto the forming section, water is removed from the wet base web to form an intermediate web and, with additional processing such as further drying and pressing if necessary, forms a sheet of cigarette paper (e.g., finished web). The cigarette paper is subsequently taken up for storage or use, e.g. the cigarette paper is coiled in a sheet or roll.

As a further addition, the oxyhydroxide compounds can be used in other portions of the smoking article, e.g., cigarette, and the smoking article components, e.g., cut filler, second wrappers, tipping paper and so forth. For example, the oxyhydroxide compounds, as described above, may optionally be provided along the length of a tobacco rod by distributing the oxyhydroxide compounds on the tobacco or incorporating them into the cut filler tobacco using any suitable method. The oxyhydroxide compounds may be provided in the form of a powder or in a solution in the form of a dispersion, for example. In a preferred method, the oxyhydroxide compounds in the form of a dry powder are dusted on the cut filler tobacco. The oxyhydroxide compounds may also be present in the form of a solution or dispersion, and sprayed on the cut filler tobacco. Alternatively, the tobacco may be coated with a solution containing the oxyhydroxide compounds. The oxyhydroxide compounds may also be added to the cut filler tobacco stock supplied to the cigarette making machine or added to a tobacco rod prior to wrapping cigarette paper around the cigarette rod.

The oxyhydroxide compounds will preferably be distributed throughout the tobacco rod portion of a cigarette and, optionally, the cigarette filter. By providing the oxyhydroxide compounds throughout the entire tobacco rod, it is possible to reduce the amount of carbon monoxide throughout the cigarette, and particularly at both the combustion region and in the pyrolysis zone.

The amount of oxyhydroxide compound to be used may be determined by routine experimentation. Preferably, the product formed from the decomposition of the oxyhydroxide during combustion of the cut filler composition is present in an amount effective to convert at least 10%, at least 20%, at least 30%, at least 40%, or at least 50% of the carbon monoxide to carbon dioxide. Preferably, the amount of the oxyhydroxide will be from about a few milligrams, for example, 5 mg/cigarette, to about 200 mg/cigarette. More preferably, the amount of oxyhydroxide will be from about 40 mg/cigarette to about 100 mg/cigarette.

In addition, the combinations of oxyhydroxide compounds containing a metal oxide disclosed herein can be used in a cut filler tobacco rod, or a cigarette similar to the disclosed uses of oxyhydroxide compounds, e.g., incorporated in cut filler, distributed along the tobacco rod length, distributed throughout the cigarette, used in powder form, or used in solution form.

One embodiment relates to a cut filler composition comprising tobacco and at least one oxyhydroxide compound, as described above, which is capable of acting as an oxidant for the conversion of carbon monoxide to carbon dioxide and/or as a catalyst for the conversion of carbon monoxide to carbon dioxide. Any suitable tobacco mixture may be used for the cut filler. Examples of suitable types of tobacco materials include flue-cured, Burley, Maryland or Oriental tobaccos, the rare or specialty tobaccos, and blends thereof. The tobacco material can be provided in the form of tobacco lamina; processed tobacco materials such as volume expanded or puffed tobacco, processed tobacco stems such as cut-rolled or cut-puffed stems, reconstituted tobacco materials; or blends thereof.

In cigarette manufacture, the tobacco is normally employed in the form of cut filler, i.e. in the form of shreds or strands cut into widths ranging from about 1/10 inch to about 1/20 inch or even 1/40 inch. The lengths of the strands range from between about 0.25 inches to about 3.0 inches. The cigarettes may further comprise one or more flavorants or other additives (e.g. burn additives, combustion modifying agents, coloring agents, binders, etc.) known in the art.

Another embodiment relates to a cigarette comprising a tobacco rod, wherein the tobacco rod comprises cut filler having at least one oxyhydroxide compound, as described above, which is capable of decomposing during smoking to produce a product that is capable of acting as an oxidant for the conversion of carbon monoxide to carbon dioxide and/or as a catalyst for the conversion of carbon monoxide to carbon dioxide. A further embodiment relates to a method of making a cigarette, comprising (i) adding an oxyhydroxide compound to a cut filler, wherein the oxyhydroxide compound is capable of decomposing during smoking to produce a product that is capable of acting as an oxidant for the conversion of carbon monoxide to carbon dioxide and/or as a catalyst for the conversion of carbon monoxide to carbon dioxide; (ii) providing the cut filler comprising the oxyhydroxide compound to a cigarette making machine to form a tobacco column; and (iii) placing a paper wrapper around the tobacco column to form a tobacco rod of the cigarette.

Techniques for cigarette manufacture are known in the art. Any conventional or modified cigarette making technique may be used to incorporate the oxyhydroxide compounds. The resulting cigarettes can be manufactured to any desired specification using standard or modified cigarette making techniques and equipment. Typically, the cut filler composition is optionally combined with other cigarette additives, and provided to a cigarette making machine to produce a tobacco column, which is then wrapped in cigarette paper, and optionally tipped with filters.

The cigarettes may range from about 50 mm to about 120 mm in length. The circumference is from about 15 mm to about 30 mm in circumference, and preferably around 25 mm. The packing density is typically between the range of about 100 mg/cm$^3$ to about 300 mg/cm$^3$, and preferably 150 mg/cm$^3$ to about 275 mg/cm$^3$.

Yet another embodiment relates to methods of smoking the cigarette described above, which involve lighting the cigarette to form smoke and drawing the smoke through the cigarette, wherein during the smoking of the cigarette, the oxyhydroxide compound decomposes during smoking to form a compound that acts as an oxidant for the conversion of carbon monoxide to carbon dioxide and/or as a catalyst for the conversion of carbon monoxide to carbon dioxide.

"Smoking" of a cigarette means the heating or combustion of the cigarette to form smoke, which can be drawn through the cigarette. Generally, smoking of a cigarette involves lighting one end of the cigarette and drawing the cigarette smoke through the mouth end of the cigarette, while the tobacco contained therein undergoes a combustion reaction. However, the cigarette may also be smoked by other means. For example, the cigarette may be smoked by heating the cigarette and/or heating using electrical heater means, as described in commonly-assigned U.S. Pat. Nos. 6,053,176; 5,934,289, 5,591,368 or 5,322,075, for example.

While various embodiments have been described, it is to be understood that variations and modifications may be resorted to as will be apparent to those skilled in the art. Such variations and modifications are to be considered within the purview and scope of the claims appended hereto.

All of the above-mentioned references are herein incorporated by reference in their entirety to the same extent as if each individual reference was specifically and individually indicated to be incorporated herein by reference in its entirety.

What is claimed is:

1. A cigarette wrapper paper comprising:

a cellulosic component; and a filler comprising an oxyhydroxide compound, wherein the oxyhydroxide compound is represented by MOOH where M is a metal selected from the group consisting of transition metals, rare earth metals, and mixtures thereof, wherein during combustion of the cigarette wrapper paper, said oxyhydroxide compound is capable of decomposing to form at least one product capable of acting as an oxidant for conversion of carbon monoxide to carbon dioxide and/or as a catalyst for conversion of carbon monoxide to carbon dioxide, and wherein the oxyhydroxide compound has a loading of 20 wt. % to 60 wt. %, based on weight of the paper prior to; wherein the loading is calculated either by the amount of oxyhydroxide compound or the product formed from the decomposition of the oxyhydroxide compound combustion.

2. The cigarette wrapper paper of claim 1, wherein said oxyhydroxide compound is capable of decomposing during combustion to form at least one product capable of acting as both an oxidant for conversion of carbon monoxide to carbon dioxide and as a catalyst for conversion of carbon monoxide in mainstream tobacco smoke to carbon dioxide.

3. The cigarette wrapper paper of claim 1, wherein M is a group IVB or a group VIII metal.

4. The cigarette wrapper paper of claim 1, wherein M is other than aluminum.

5. The cigarette wrapper paper of claim 1, wherein the oxyhydroxide compound is selected from the group consisting of FeOOH, TiOOH, and mixtures thereof.

6. The cigarette wrapper paper of claim 1, wherein the oxyhydroxide compound and/or the product formed from the decomposition of the oxyhydroxide is in the form of nanoparticles.

7. The cigarette wrapper paper of claim 1, wherein the oxyhydroxide compound and/or the product formed from the decomposition of the oxyhydroxide has an average particle size of greater than one micron to less than three microns.

8. The cigarette wrapper paper of claim 7, wherein the average particle size is from about one micron to about two microns.

9. The cigarette wrapper paper of claim 7, wherein the average particle size is about 0.5 microns to 1.5 microns.

10. The cigarette wrapper paper of claim 1, wherein the loading is from 20 wt. % of the paper to 50 wt. % of the paper.

11. The cigarette wrapper paper of claim 1, wherein the loading is from 20 wt. % of the paper to 40 wt. % of the paper.

12. The cigarette wrapper paper of claim 1, wherein the filler further comprises a paper filler material.

13. The cigarette wrapper paper of claim 12, wherein the paper filler material includes an oxide, a carbonate, or a hydroxide of a Group II, Group III or Group IV metal.

14. The cigarette wrapper paper of claim 13, wherein the paper filler material is selected from the group consisting of $CaCO_3$, $TiO_2$, $SiO_2$, $Al_2O_3$, $MgCO_3$, MgO and $Mg(OH)_2$ and mixtures thereof.

15. The cigarette wrapper paper of claim 14, wherein the paper filler material is $CaCO_3$.

16. The cigarette wrapper paper of claim 12, wherein a ratio in weight percent of oxyhydroxide compound to wt. % of paper filler material is from 1:9 to 9:1.

17. The cigarette wrapper paper of claim 16, wherein the ratio is from 1:4 to 4:1.

18. The cigarette wrapper paper of claim 17, wherein the ratio is 1:1.

19. The cigarette wrapper paper of claim 1, wherein the oxyhydroxide compound is capable of decomposing during combustion to form a metal oxide of the metal.

20. The cigarette wrapper paper of claim 1, wherein the oxyhydroxide compound is capable of decomposing during combustion to form at least one product selected from the group consisting of $Fe_2O_3$, $TiO_2$, and mixtures thereof.

21. The cigarette wrapper paper of claim 1, wherein the product formed from the decomposition of the oxyhydroxide during combustion is present in an amount effective to convert at least 25% of the carbon monoxide to carbon dioxide.

22. A cigarette comprising the wrapper of claim 1, the wrapper encasing a tobacco column.

23. The cigarette of claim 22, wherein the tobacco column comprises a cut filler composition comprising tobacco and a filler comprising an oxyhydroxide compound, wherein during smoking of the cigarette, said oxyhydroxide compound in the cut filler composition is capable of decomposing to form at least one product capable of acting as an oxidant for the conversion of carbon monoxide to carbon dioxide and/or as a catalyst for the conversion of carbon monoxide in mainstream tobacco smoke to carbon dioxide.

24. The cigarette of claim 23, wherein the cigarette comprises from about 5 mg to about 200 mg of the oxyhydroxide compound per cigarette.

25. A method of smoking the cigarette of claim 22, comprising lighting the cigarette to form smoke and drawing the smoke through the cigarette, wherein during the smoking of the cigarette, the oxyhydroxide compound is capable of decomposing to form at least one product capable of acting as an oxidant for the conversion of carbon monoxide in mainstream tobacco smoke to carbon dioxide and/or as a catalyst for the conversion of carbon monoxide in mainstream tobacco smoke to carbon dioxide.

26. The cigarette wrapper paper of claim 1, further comprising an iron oxide, wherein the iron oxide is present in the cigarette wrapper paper at a loading of up to 40 wt % of the paper.

27. The cigarette wrapper paper of claim 26, wherein the loading of iron oxide is from 15 wt. % of the paper to 40 wt % of the paper.

28. A cigarette comprising the wrapper of claim 26, the wrapper encasing a tobacco column.

29. The cigarette of claim 28, wherein the tobacco column comprises a cut filler composition comprising tobacco and at least one of an oxyhydroxide compound and an iron oxide.

30. The cigarette of claim 29, wherein during smoking of the cigarette, said oxyhydroxide compound in the cut filler composition is capable of decomposing to form at least one product capable of acting as an oxidant for the conversion of carbon monoxide in mainstream tobacco smoke to carbon dioxide and/or as a catalyst for the conversion of carbon monoxide in mainstream tobacco smoke to carbon dioxide.

31. The cigarette of claim 30, wherein the cigarette comprises from about 5 mg to about 200 mg of the oxyhydroxide compound per cigarette.

32. A method of smoking the cigarette of claim 28, comprising lighting the cigarette to form smoke and drawing the smoke through the cigarette, wherein during the smoking of the cigarette, the oxyhydroxide compound is capable of decomposing to form at least one product capable of acting as an oxidant for the conversion of carbon monoxide to carbon dioxide and/or as a catalyst for the conversion of carbon monoxide in mainstream tobacco smoke to carbon dioxide.

33. The cigarette wrapper paper of claim 26, further comprising a paper filler material wherein the paper filler material is mixed with the iron oxide or supports the iron oxide.

34. The cigarette wrapper paper of claim 33, wherein the paper filler material is selected from the group consisting of calcium carbonate, $TiO_2$, $SiO_2$, $Al_2O_3$, $MgCO_3$, MgO and $Mg(OH)_2$ and mixtures thereof.

35. The cigarette wrapper paper of claim 34 wherein the paper filler material includes calcium carbonate.

36. A cigarette comprising the wrapper of claim 33, the wrapper encasing a tobacco column.

37. The cigarette of claim 36, wherein the tobacco column comprises a cut filler composition comprising tobacco and at least one of an oxyhydroxide compound and an iron oxide.

38. The cigarette of claim 37, wherein during smoking of the cigarette, said oxyhydroxide compound in the cut filler composition is capable of decomposing to form at least one product capable of acting as an oxidant for the conversion of carbon monoxide in mainstream tobacco smoke to carbon dioxide and/or as a catalyst for the conversion of carbon monoxide in mainstream tobacco smoke to carbon dioxide.

39. The cigarette of claim 38, wherein the cigarette comprises from about 5 mg to about 200 mg of the oxyhydroxide compound per cigarette.

40. A method of smoking the cigarette of claim 36, comprising lighting the cigarette to form smoke and drawing the smoke through the cigarette, wherein during the smoking of the cigarette, the oxyhydroxide compound is capable of decomposing to form at least one product capable of acting as an oxidant for the conversion of carbon monoxide mainstream tobacco smoke to carbon dioxide and/or as a catalyst for the conversion of carbon monoxide in mainstream tobacco smoke to carbon dioxide.

41. The cigarette wrapper paper of claim 26, wherein the iron oxide is selected from the group consisting of $\gamma$-$Fe_2O_3$, $Fe_3O_4$, and mixtures thereof.

42. A cigarette wrapper paper comprising:

a cellulosic component; and an oxyhydroxide compound, wherein the oxyhydroxide compound is represented by MOOH where M is a metal selected from the group consisting of Fe, Ti, and mixtures thereof, wherein during combustion of the cigarette wrapper paper, said oxyhydroxide compound is capable of decomposing to form at least one product capable of acting as an oxidant for conversion of carbon monoxide in mainstream tobacco smoke to carbon dioxide and/or as a catalyst for conversion of carbon monoxide in mainstream tobacco smoke to carbon dioxide, wherein the oxyhydroxide compound and/or the product formed from the decomposition of the oxyhydroxide has an average particle size of greater than one micron to less than three microns, and wherein the oxyhydroxide compound has a loading of 20 wt. % to 60 wt. %, based on weight of the paper prior to; wherein the loading is calculated either by the amount of oxyhydroxide compound or the product formed from the decomposition of the oxyhydroxide compound combustion.

43. A cigarette comprising the wrapper of claim 42, the wrapper encasing a tobacco column.

44. A method of smoking the cigarette of claim 43, comprising lighting the cigarette to form smoke and drawing the smoke through the cigarette, wherein during the smoking of the cigarette, the oxyhydroxide compound is capable of decomposing to form at least one product capable of acting as an oxidant for the conversion of carbon monoxide in mainstream tobacco smoke to carbon dioxide and/or as a catalyst for the conversion of carbon monoxide in mainstream tobacco smoke to carbon dioxide.

45. The cigarette wrapper paper of claim 42, further comprising an iron oxide, wherein the iron oxide is present in the cigarette wrapper paper at a loading of up to 40 wt % of the paper.

46. A cigarette comprising the wrapper of claim 45, the wrapper encasing a tobacco column.

47. A method of smoking the cigarette of claim 46, comprising lighting the cigarette to form smoke and drawing the smoke through the cigarette, wherein during the smoking of the cigarette, the oxyhydroxide compound is capable of decomposing to form at least one product capable of acting as an oxidant for the conversion of carbon monoxide in mainstream tobacco smoke to carbon dioxide and/or as a catalyst for the conversion of carbon monoxide in mainstream tobacco smoke to carbon dioxide.

48. The cigarette wrapper paper of claim 45, further comprising a paper filler, wherein a ratio in weight percent of iron oxide to wt. % of paper filler is from 1:9 to 9:1.

49. A cigarette comprising the wrapper of claim 48, the wrapper encasing a tobacco column.

50. The cigarette wrapper paper of claim 42, wherein the loading is from 20 wt. % of the paper to 50 wt. % of the paper.

51. The cigarette wrapper paper of claim 50, wherein the loading is from 20 wt. % of the paper to 40 wt. % of the paper.

52. The cigarette wrapper paper of claim 41, wherein the iron oxide includes $\gamma$-$Fe_2O_3$.

53. The cigarette wrapper paper of claim 52, wherein the $\gamma$-$Fe_2O_3$ has a particle size of from 20 nanometers to 1 micron.

* * * * *